US008353670B2

(12) United States Patent
Glasspoole et al.

(10) Patent No.: US 8,353,670 B2
(45) Date of Patent: Jan. 15, 2013

(54) AXIAL BALANCING CLIP WEIGHT FOR ROTOR ASSEMBLY AND METHOD FOR BALANCING A ROTOR ASSEMBLY

(75) Inventors: David F. Glasspoole, St. Lambert (CA); Rene Paquet, Montreal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 636 days.

(21) Appl. No.: 12/512,468

(22) Filed: Jul. 30, 2009

(65) Prior Publication Data

US 2011/0027085 A1 Feb. 3, 2011

(51) Int. Cl.
*F01D 5/10* (2006.01)

(52) U.S. Cl. ..... 416/144; 416/500

(58) Field of Classification Search ..... 416/144, 416/145, 500

See application file for complete search history.

(56) References Cited

U.S. PATENT DOCUMENTS

| | | | | |
|---|---|---|---|---|
| 2,366,795 | A | 1/1945 | Lamoreaux | |
| 2,610,823 | A | 9/1952 | Knowlton, Jr. | |
| 3,687,244 | A | 8/1972 | Hillegass et al. | |
| 4,192,633 | A * | 3/1980 | Herzner | 416/221 |
| 4,220,055 | A | 9/1980 | Dubois et al. | |
| 4,480,959 | A * | 11/1984 | Bourguignon et al. | 416/220 R |
| 4,803,893 | A | 2/1989 | Bachinski | |
| 4,842,485 | A | 6/1989 | Barber | |
| 4,879,792 | A | 11/1989 | O'Connor | |
| 4,926,710 | A | 5/1990 | Novotny | |
| 5,011,374 | A | 4/1991 | Miller | |
| 5,470,203 | A * | 11/1995 | Mori et al. | 416/144 |
| 6,358,009 | B1 | 3/2002 | Link | |
| 6,481,969 | B2 | 11/2002 | Berry et al. | |
| 6,729,694 | B2 | 5/2004 | Maruyama | |
| 6,893,222 | B2 | 5/2005 | Allam | |
| 7,377,749 | B2 | 5/2008 | Charrier et al. | |
| 7,491,031 | B2 | 2/2009 | Brault et al. | |
| 2006/0236796 | A1 * | 10/2006 | Harada | 74/52 |

OTHER PUBLICATIONS

The Office Action dated Jun. 8, 2011, in related Canadian Patent Application No. 2,709,140.

* cited by examiner

*Primary Examiner* — Christopher Verdier
*Assistant Examiner* — Andrew C Knopp
(74) *Attorney, Agent, or Firm* — Norton Rose Canada LLP

(57) ABSTRACT

A balancing weight clip for balancing a rotor assembly of a gas turbine engine which includes a weight portion, and a first flange engaging portion and a second flange engaging portion extending from the weight portion. The weight portion and the first and second flange engaging portions define a flange receiving opening for receiving a flange of a disc of the rotor assembly. The first flange engaging portion is provided with a detent facing the second flange engaging portion and engageable with a mating groove provided on a face of the flange. At least one of the first and second flange engaging portions is elastically deformable so that the first and second flange engaging portions are elastically moveable away from one another to removably receive the flange in the flange receiving opening and engage the detent with the mating groove.

20 Claims, 5 Drawing Sheets

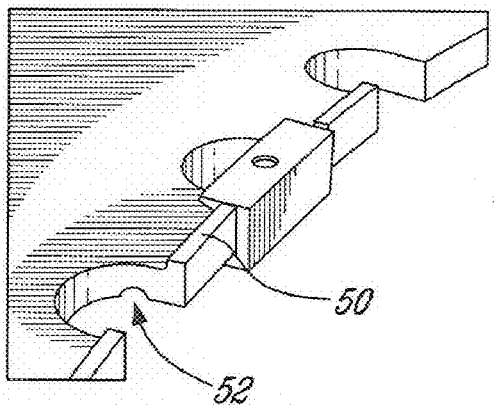
Fig. 4a
Fig. 4b
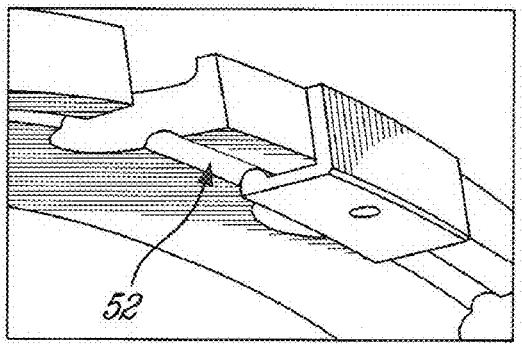
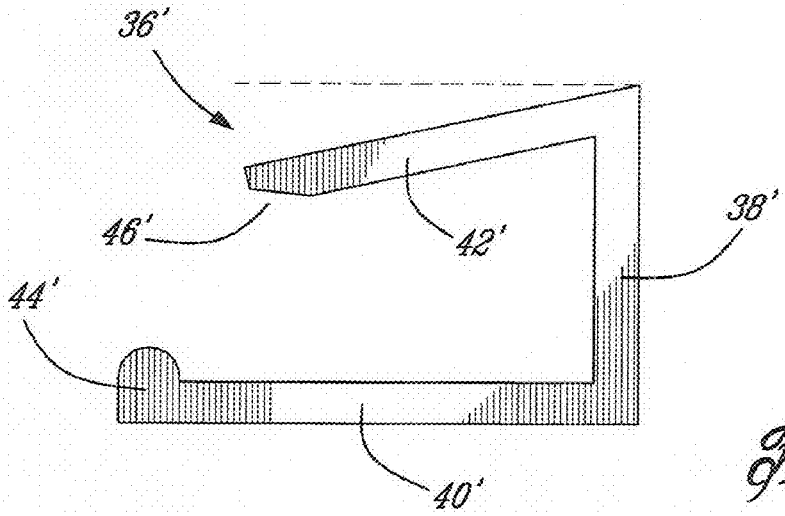
Fig. 5

AXIAL BALANCING CLIP WEIGHT FOR ROTOR ASSEMBLY AND METHOD FOR BALANCING A ROTOR ASSEMBLY

TECHNICAL FIELD

The application relates generally to gas turbine engines, more particularly to weight balancing methods and devices for rotor assemblies in such gas turbine engines.

BACKGROUND

In gas turbine engines, balancing rotors is of importance for reducing vibrations. Usually, in order to balance a rotor, balancing weights are secured to the rotor at a particular circumferential position using additional securing devices, such as rivets for example. In addition to increasing the total weight of the assembly, the use of such additional securing devices increases the complexity of the assembly.

Accordingly, there is a need to provide an improved balancing weight device for balancing a rotor assembly of a gas turbine engine.

SUMMARY

There is provided a rotor assembly for a gas turbine engine, comprising: a disc adapted for mounting to an engine shaft defining a longitudinal axis, the disc having two opposed faces and a circumferential blade receiving edge therebetween adapted for mounting of a plurality of radially projecting blades; an axially extending flange projecting from one of the two opposed faces of the disc and circularly extending thereon, the flange having a circumferential groove; and at least one balancing weight clip having a mass adapted for balancing the rotor assembly and comprising a first flange engaging portion, a second flange engaging portion and a weight portion therebetween, the weight portion and the first and second flange engaging portions defining a flange receiving opening, the first flange engaging portion being provided with a detent facing the second flange engaging portion and mating with the circumferential groove, the at least one balancing weight clamp being removably secured to the flange in a secured position wherein the flange is received in the flange receiving opening and the detent engages the circumferential groove, the balancing weight clip being immobile in an axial and circumferential direction when in the secured position, at least one of the first and second flange engaging portions being elastically deformable so that the first and second flange engaging portions are elastically moveable away from one another to receive the flange in the flange receiving opening.

There is also provided a balancing weight clip having a mass adapted to balance a rotor assembly of a gas turbine engine, comprising: a weight portion; and a first flange engaging portion and a second flange engaging portion extending from the weight portion, the weight portion and the first and second flange engaging portions defining a flange receiving opening for receiving a flange of a disc of the rotor assembly, the first flange engaging portion being provided with a detent facing the second flange engaging portion and engageable with a mating groove provided on a face of the flange, at least one of the first and second flange engaging portions being elastically deformable so that the first and second flange engaging portions are elastically moveable away from one another to removably receive the flange in the flange receiving opening and engage the detent with the mating groove.

There is further provided a method for balancing a rotor disc having two opposed faces and an axially extending flange projecting from one of the two opposed faces of the disc and circularly extending thereon, the flange having a circumferential groove, the method comprising: abutting a balancing weight clip against the flange of the rotor disc, the balancing weight clip having a weight portion and a first flange engaging portion and a second flange engaging portion extending from the weight portion, the weight portion and the first and second flange engaging portions defining a flange receiving opening for receiving the flange of the rotor disc, the first flange engaging portion being provided with a detent facing the second flange engaging portion and mating with the circumferential groove, at least one of the first and second flange engaging portions being elastically deformable, the balancing weight clip having a weight adapted to balance the rotor disc, the abutting the balancing weight clip comprising abutting at least one of the first and second flange engaging portions against the flange; and exerting a force on the weight portion in order to insert the flange in the flange receiving opening and engage the detent in the circumferential groove, the exerting the force resulting in elastically moving away the first and second flange engaging portions from one another,

DESCRIPTION OF THE DRAWINGS

Reference is now made to the accompanying figures, in which:

FIG. 4*a* is a partial perspective top view of the scalloped flange of FIG. 2 to which the balancing weight clip of FIGS. 3*a* and 3*b* is secured;

FIG. 4*b* is a partial perspective bottom view of the scalloped flange of FIG. 2 to which the balancing weight clip of FIGS. 3*a* and 3*b* is secured;

FIG. 5 is a side view of a triangular balancing weight clip, in accordance with an embodiment;

DETAILED DESCRIPTION

Figure 1:
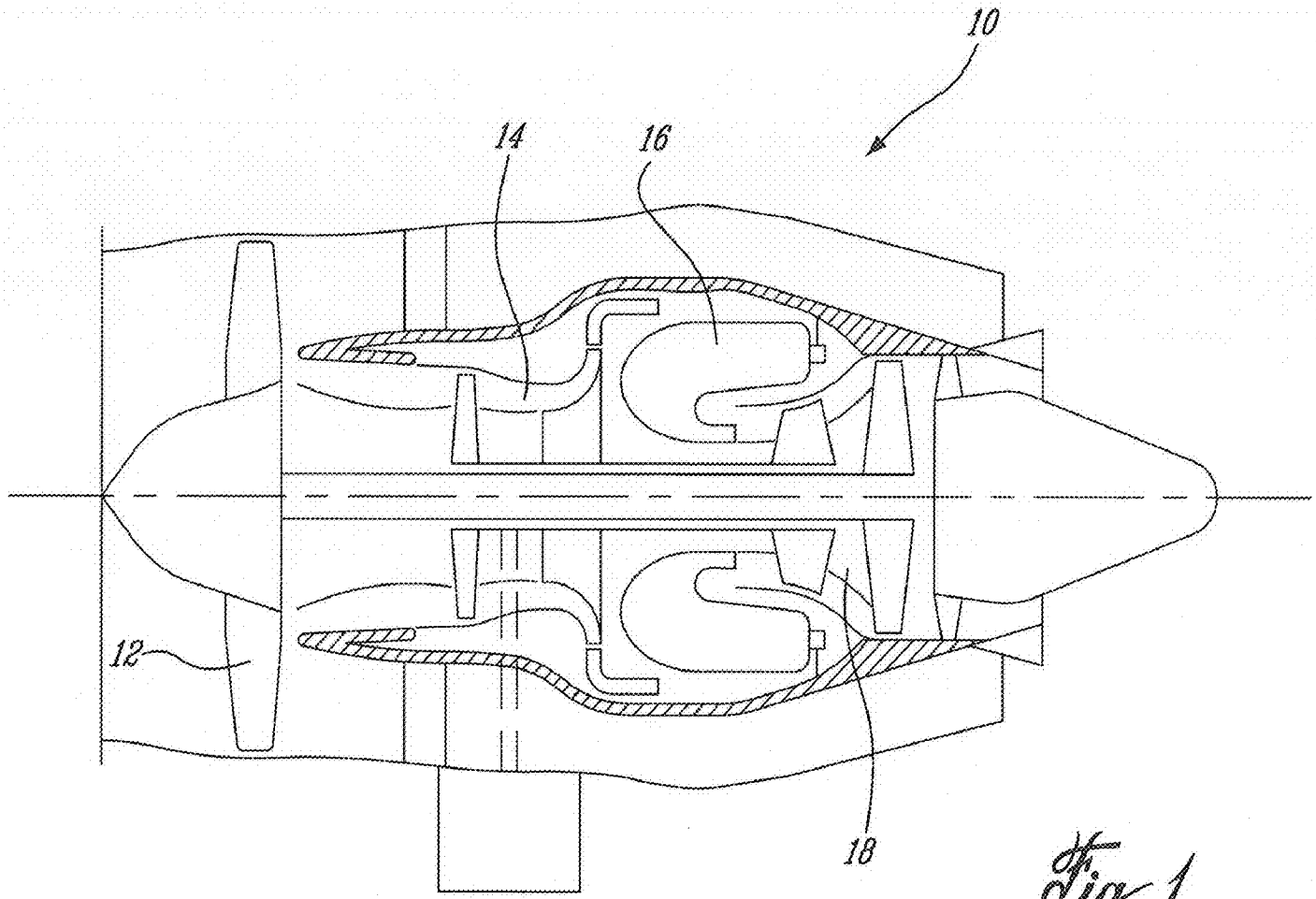
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
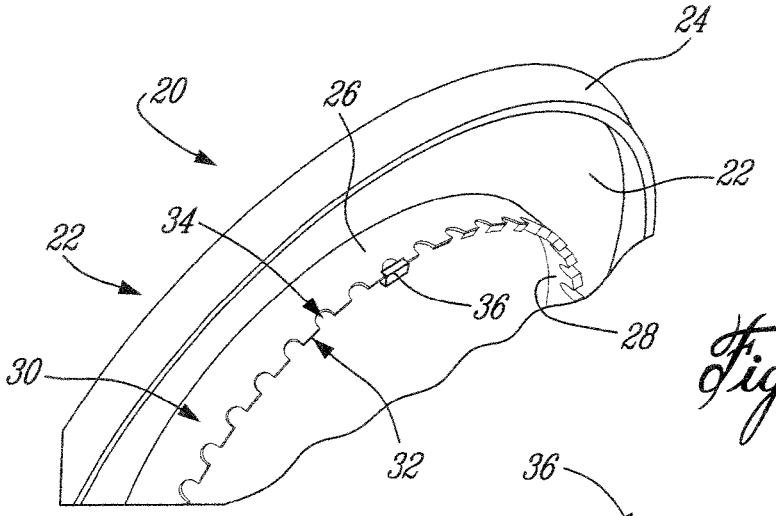
FIG. 2 is a partial perspective view of a rotor disk having a scalloped flange, in accordance with an embodiment.

FIG. 2 illustrates a disc 20 adapted to form a rotor assembly when mounted to an engine shaft of a gas turbine engine such as shown in FIG. 1. The disc 20 is to be mounted perpendicularly to a longitudinal axis of the engine shaft such that a rotation of the engine shaft drives the disc 20. The disc 20 comprises two opposed circular faces 22 and a blade receiving edge 24 which extends circumferentially between the two opposed faces 22. The edge 24 is adapted to receive blades (not shown) projecting radially therefrom. A circular flange 26 is concentrically mounted to the disc 20. The flange 26 projects parallel to the axis of the engine shaft from one face 22 of the disc 20.

The flange 26 has an inward face 28 and an outward face 30 separated by a circumferential edge 32. The circumferential edge 32 is provided with a plurality of scallop recesses 34 located about the circumference of the flange 26. Each scallop recess 34 extends through the thickness of the flange 26 from the inward face 28 to the outward face 30. The scallop recesses 34 reduce or substantially eliminate the hoop stress while reducing the overall rotor assembly weight.

At least one balancing weight clip 36 is removably secured to the flange 26. The mass and the circumferential position about the flange of the balancing weight clip 36 are chosen so that the rotor assembly is balanced when the balancing weight clip 36 is removably secured to the flange 26 at said one position. As illustrated in FIG. 2, the balancing weight clip 36 is positioned on the flange 26 such that it bridges a scallop recess 34.

Figure 3A:
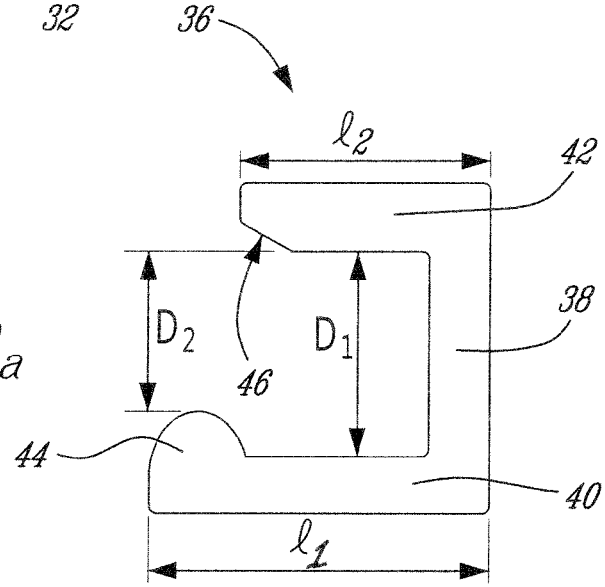
FIGS. 3*a* and 3*b* illustrate a rectangular balancing weight clip, in accordance with an embodiment.
Figure 3B:
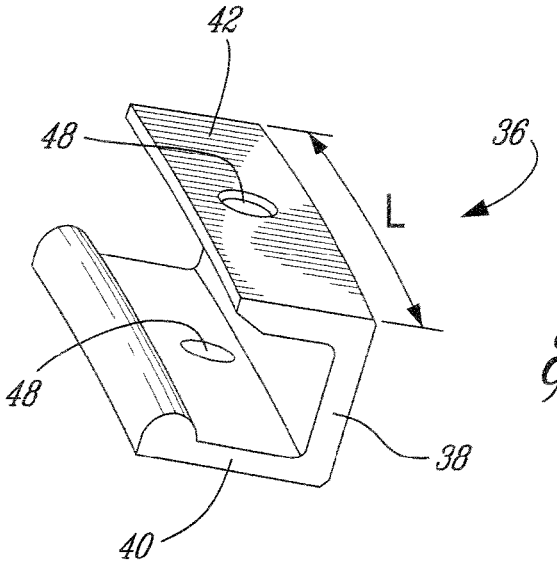

FIGS. 3*a* and 3*b* illustrate one embodiment of the balancing weight clip 36 in an unsecured position, i.e. when the balancing weight clip 36 is not secured to the flange 26. The balancing weight clip 36 is substantially U-shaped and comprises a weight portion 38, a first flange engaging portion 40, and a second flange engaging portion 42. The first and second flange engaging portions 40 and 42 project substantially perpendicularly from the weight portion 38. The weight portion 38 and the first and second flange engaging portions 40 and 42 define a flange receiving opening. The first engaging portion 40 is provided with a detent 44 which faces the second flange engaging portion 42. At a distal end, the second flange engaging portion 42 is provided with an inclined insertion face 46. The inclined insertion edge 46 facilitates the attachment of the balancing weight clip 36 to the flange 26. The balancing weight clip is further provided with a hole 48 on the first and second flange engaging portions 40 and 42. The holes 48 are vertically aligned together to face each other.

In this embodiment, the weight portion 38 and the first and second flange engaging portions 40 and 42 have the same length L. As best seen in FIG. 3*a*, the second flange engaging portion 42 has a width $I_2$ which is shorter than the width $I_1$ of the first flange engaging portion 40. The distance D1 which separates the first and second flange engaging portion 40 and 42 adjacent to the weight portion 38 is substantially equal to the thickness of the flange 26. The distance D2 which separates the detent 44 and the second flange engaging portion 42 is shorter than the thickness of the flange 26. At least one of the first and second flange engaging portions 40 and 42 is elastically deformable to allow the engagement and disengagement of the balancing weight clip 36 to the flange 26. Accordingly, the first and second flange engaging portions 40 and 42 are not plastically deformed upon installation of the balancing weight clip 36 to the flange 26. The flange engaging portions 40 and 42 may be made of any suitable material providing the yield is not exceeded during the elastic deformation required to fasten the balancing weight clip 30 to the flange and provided that the material selected is able to survive the gas turbine engine environment.

FIGS. 4*a* and 4*b* illustrate the flange 26 to which the balancing weight clip 36 is removably attached. The flange 26 is provided with a plurality of rail segments 50 adjacent to the flange edge 32 on its outward face 30 to form a rail which discontinuously extends about the circumference of the flange 26. Each rail segment 50 extends between two adjacent scallop recesses 34 without reaching the scallop recesses 34 so that the circumferential length of the rail segment 50 is inferior to the circumferential distance between two following scallop recesses 34. The part of the flange 26 located between a scallop recess 34 and a rail segment 50 defines a weight receiving portion. The distance between two following rail segments 50 is substantially equal to the length L of the balancing weight clip. The flange 26 is also provided with a groove 52 which extends circumferentially on the inward face 28 of the flange 26. The groove 52 is sized and shaped to mate with the detent 44.

When the balancing weight clip 36 is in an engaged position, i.e. when the balancing weight clip 36 is removably secured to the flange 26, the balancing weight clip 36 bridges a corresponding scallop recess 34 since the circumferential length of the scallop recess 34 is shorter than the length L of the balancing weight clip 36. As the distance D1 between the first and second flange engaging portions 40 and 42 of the balancing weight clip 36 is substantially equal to the thickness of the flange 26, the second flange engaging portion 42 engages the weight receiving portions of the flange 26 adjacent to the scallop recess 34 and the first flange engaging portion 40 engages the inward face 28 of the flange 26. In the engaged position, the detent 44 engages the groove 52. The groove 52 longitudinally retains the balancing weight clip 36 so as to prevent any displacement of the balancing weight clip 36 in the direction of the rotational axis of the disc 20. The rail segments 50 located on each side of the balancing weight clip 36 prevent any circumferential displacement of the balancing weight clip about the flange 26. As a result, the balancing weight clip 36 is fixedly maintained in position during a rotation of the disc 20 while being removable from the flange 26 without requiring any additional fasteners such as screws, bolts, adhesive, and the like.

The circumferential position, i.e. the particular scallop recess 34 over which the balancing weight clip is to be secured, and the weight of the balancing weight clip are chosen to balance the disc 20 and/or the rotor assembly comprising the disc 20. The length L of the balancing weight clip 36 is adapted to the curvature of the flange 26 so that the detent 44 is engageable with the groove 52 and the second flange engaging portion 42 is engageable with the rail segments 50. It should be noted that a number of balancing weight clips 36 can be secured to flange 26 at predetermined circumferential positions as required to balance the disc 20.

In on embodiment, a rivet (not shown) is used for substantially preventing any circumferential displacement of the balancing weight clip 36 about the flange 26. The rivet is engaged into the holes 58 of the first and second flange engaging portions to fixedly secure the balancing weight clip 36. Thus, both the rail 50 and the rivet may be used to prevent the circumferential displacement of the balancing weight clip 36 on the flange 26.

In one embodiment, the disc 20 is part of a rotor assembly present in the multistage compressor 14 such as shown in FIG. 1. Alternatively, the disc can be part of a rotor assembly present in the turbine section 18 illustrated in FIG. 1.

It should be understood that the shape and size of the scallop recess 34 may vary as along as the circumferential length of the scallop recess 34 is shorter than the length L of the balancing weight clip 36. For example, in one embodiment, the circumferential length of the scallop recess is substantially equal to the diameter of the holes 48. As a result, when a rivet is inserted in the holes 48 and the recess 34, the rivet abuts the wall of the holes 48 and the wall of the recess 34. This particular arrangement prevents any circumferential displacement of the balancing weight clip about the flange 26.

FIG. 5 illustrates an alternate balancing weight clip 36' comprising a weight portion 38', and a first and second flange engaging portion 40' and 42' which together define a flange receiving opening. The balancing weight clip 36' has dimensions adapted to the flange 26 such that it can be secured thereto. The first flange engaging portion 40' projects perpendicularly from the weight portion 38' while the second flange engaging portion 42' is inclined towards the first flange engaging portion 40'. As a result, the distance between the first and second flange engaging portions 40' and 42' proximal to the weight portion 38' is substantially equal to the thickness of the flange 26 while the distance between the first and second flange engaging portions 40' and 42' distal to the weight portion 38' is shorter than the thickness of the flange 26. The first flange engaging portion 40' is provided at a distal end with a detent 44' mating with the circumferential groove 52 of the flange 26. The second flange engaging portion 42' is provided with a rounded insertion face at a distal end.

Because the second flange engaging portion 42' is elastically deformable, the balancing weight clip 36' can be removably secured to the flange 26. When the balancing weight clip 36' is in a secured position, the first and second flange engaging portions 40' and 42' exert a force directed towards the flange 26. This force helps the balancing weight clip 36' to remain in the secured position. In another embodiment, both the first and second flange engaging portions 40' and 42' are inclined and elastically deformable. Alternatively, only the first flange engaging portion 40' can be inclined and elastically deformable.

Figure 6:
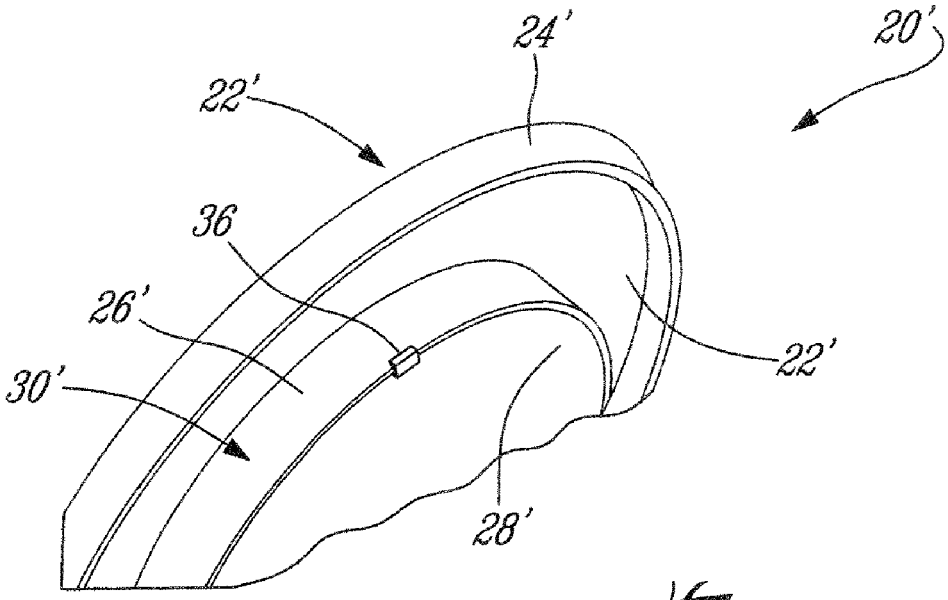
FIG. 6 is a partial perspective view of a rotor disk provided with a full flange, in accordance with an embodiment.

FIG. 6 illustrates one embodiment of a disc 20' adapted to form a rotor assembly when mounted to an engine shaft (not shown) of a gas turbine engine such as shown in FIG. 1. The disc 20' is to be mounted perpendicularly to a longitudinal axis of the engine shaft such that a rotation of the engine shaft drives the disc 20'. The disc 20' comprises two opposed circular faces 22' and a blade receiving edge 24' which extends circumferentially between the two opposed faces 22'. The edge 24' is adapted to receive blades (not shown) projecting radially therefrom. A circular flange 26' is concentrically and circularly mounted to the disc 20'. The flange 26' projects parallel to the axis of the engine shaft from one face 22' of the disc 20'. The flange 26' has an inward face 28' and an outward face 30' separated by a circumferential edge 32'. The circumferential edge 32' is linear and not scalloped such as the circumferential edge 32 illustrated in FIGS. 2, 4*a*, and 4*b*.

A balancing weight clip such as the balancing weight clip 36 is removably secured to the flange 26'. The weight and the circumferential position about the flange of the balancing weight clip 36 are chosen so that the rotor assembly and/or the disc 20' is balanced when the balancing weight clip is removably secured to the flange 26'.

Figure 7:
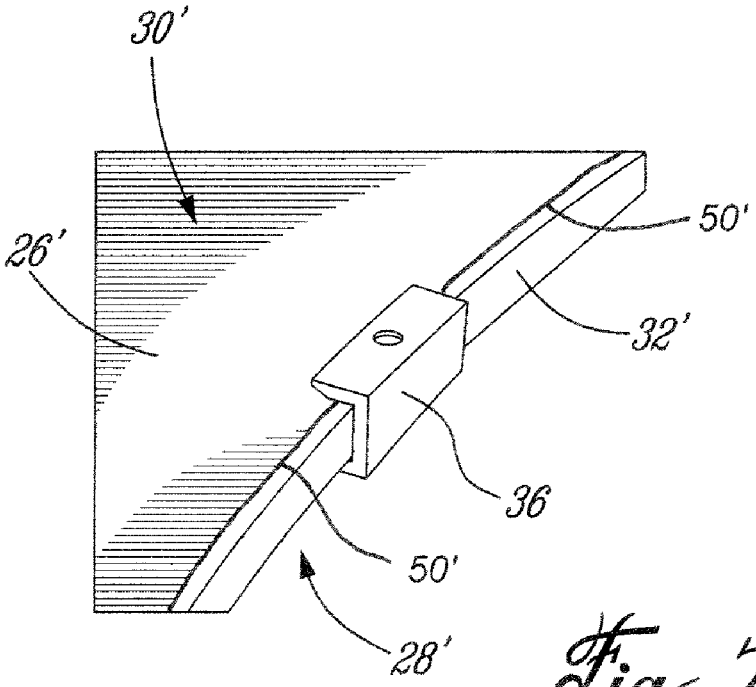
FIG. 7 is a partial perspective top view of the full flange of FIG. 6.

FIG. 7 illustrates the flange 26' to which the balancing weight clip 36 is removably attached, in accordance with an embodiment. The flange 26' is provided with a plurality of rail segments 50' adjacent to the flange edge 32' on its outward face 30' to form a rail which discontinuously extends about the circumference of the flange 26'. The distance between two following rail segments 50' is substantially equal to the length L of the balancing weight clip 36. The flange 26' is also provided with a circumferential groove (not shown) which extends circumferentially on the inward face 28' of the flange 26'. The groove sized and shaped to mate with the detent 44 of the balancing weight clip 36.

When the balancing weight clip 36 is in an engaged position, i.e. when the balancing weight clip 36 is removably secured to the flange 26', the balancing weight clip 36 is located between two following rail segments 50'. The detent 44 of the balancing weight clip 36 engages the circumferential recess of the flange 26' and the lateral faces of the second flange engaging portion 42 of the balancing weight clip 36 engage the rail segments 50'. The circumferential groove longitudinally retains the balancing weight clip 36 so as to prevent any displacement of the balancing weight clip 36 in the direction of the rotational axis of the disc 20'. The rail segments 50' located on each side of the balancing weight clip 36 prevent any circumferential displacement of the balancing weight clip 36 about the flange 26'. As a result, the balancing weight clip 36 is fixedly maintained in position during a rotation of the disc 20' while being removable from the flange 26'. The spaces between two following rail segments 50' define discrete circumferential positions where the balancing weight clip 36 can be attached.

In one embodiment, the disc 20' is part of a rotor assembly present in the multistage compressor 14 such as shown in FIG. 1. Alternatively, the disc 20' can be part of a rotor assembly present in the turbine section 18 illustrated in FIG. 1.

While FIGS. 6 and 7 illustrate the balancing weight clip 36 removably secured to the flange 26' of the disc 20', it should be understood that the balancing weight clip 50 can also be used for balancing the disc 20' or the rotor assembly.

While the flanges 26 and 26' are each provided with a circumferential groove, respectively, on the inward face 28, 28', respectively, and rail segments 50, 50', respectively, on the outward face 30, 30', respectively, it should be understood that the circumferential groove can be located on the outward face 30, 30' and the rail segments 50, 50 can be located on the inward face 28, 28', Alternatively, both the circumferential groove and the rail segments 50, 50' can be located on the same face.

In a particular embodiment, the circumferentiai groove 52 is discontinuous about the circumference of the flange 26. In this case, the groove 52 comprises a plurality of discrete grooves, each being located between two following rail segments 50. In a particular embodiment, the circumferential length of each groove segment is substantially equal to the length L of the balancing weight clip 36, 36'. In this case, the flange 26, 26' can be free from any rail segments and the lateral walls of the grove segments prevent any circumferential displacement of the balancing weight clip 36, 36' about the flange 26, 26'. The position of the groove segments define the discrete positions where the balancing weight clip 36, 36' can be removably secured.

It should be understood that the shape and the dimensions of the balancing weight clip 36, 36' may vary as long as at least one of the first and second flange engaging portions 40, 40' and 42, 42' is elastically deformable to allow the engagement of the balancing weight clip 36, 36' to the flange 26, 26'. For example, while the balancing weight clip 36 illustrated in FIGS. 3*a* and 3*b* comprises rectangular flange engaging portions 40 and 42, the flange engaging portions may be rounded. In another example, the width $I_2$ of the second flange engaging portion 42 is substantially equal to the width $I_1$ of the first flange engaging portion 40. While in the embodiment illustrated in FIGS. 3*a* and 3*b*, the weight portion 38 and the first and second flange engaging portions 40 and 42 have the same length L, the portions 38, 40, and 42 of the balancing weight clip 36 can have different lengths. For example, the length of the weight portion 38 may be larger or shorter than that of the first and second flange engaging portions 40 and 42. While the balancing weight clip 36 is provided with the holes 48 on the first and second flange engaging portions 40 and 42, it should be understood the balancing weight clip 36 may be free from any holes 48. In this case, only the rail segments 50 of the flange 46 prevent the rotation of the balancing weight clip 36 about the flange 26.

While the balancing weight clip 36, 36' comprise a weight portion 38, 38', and a first and second flange engaging portion 40, 40' and 42, 42' which are planar, the balancing weight clip 36, 36' may be curved along its length L. In this case, the curvature of the first and second flange engaging portions 40, 40' and 42, 42' along their respective length L is substantially equal to that of the flange 26, 26'.

The balancing weight clip 36, 36' may be made of any adequate material or combination of materials which allows at least one the flange engaging portions 40, 40' and 42, 42' to be elastically deformable during the attachment of the balancing weight clip 36, 36' to the flange 26, 26' and to substantially recover its initial shape once disengaged from the flange 26, 26'.

It should also be understood that the dimensions of the weight portion 38, 38', the first flange engaging portion 40, 40', and/or the second flange engaging portion 42, 42' can be varied in order to vary the weight of the balancing weight clip 36, 36'. Alternatively, the material of the balancing weight clip 36, 36' may be varied to vary the weight of the balancing weight clip 36, 36'.

While the detent 44, 44' has a bulb shape, it should be understood that the detent 44, 44' may have any adequate shape which allows the balancing weight clip 36, 36' to be retained in the axial direction once in the engaged position. For example, the detent 44, 44' may have a square or rectangular shape. Alternatively, the detent 44, 44' may also be a hook. In these cases, the circumferential groove of the flange 26, 26' has a shape mating with that of the detent 44, 44' so that the detent 44, 44' is engageable with the groove.

In an alternate embodiment, the disc 20, 20' may be provided with several flanges 26, 26' located at different radial positions on the disc, thereby providing the ability to select a desired radial position of the balancing weight clip 36, 36' on the disc, in addition to being able circumferentially locate the clip for optimal balancing of the disc assembly.

The rotor disk 20, 20' as described may, in one particular embodiment, be a powder metal rotor.

Figure 8:
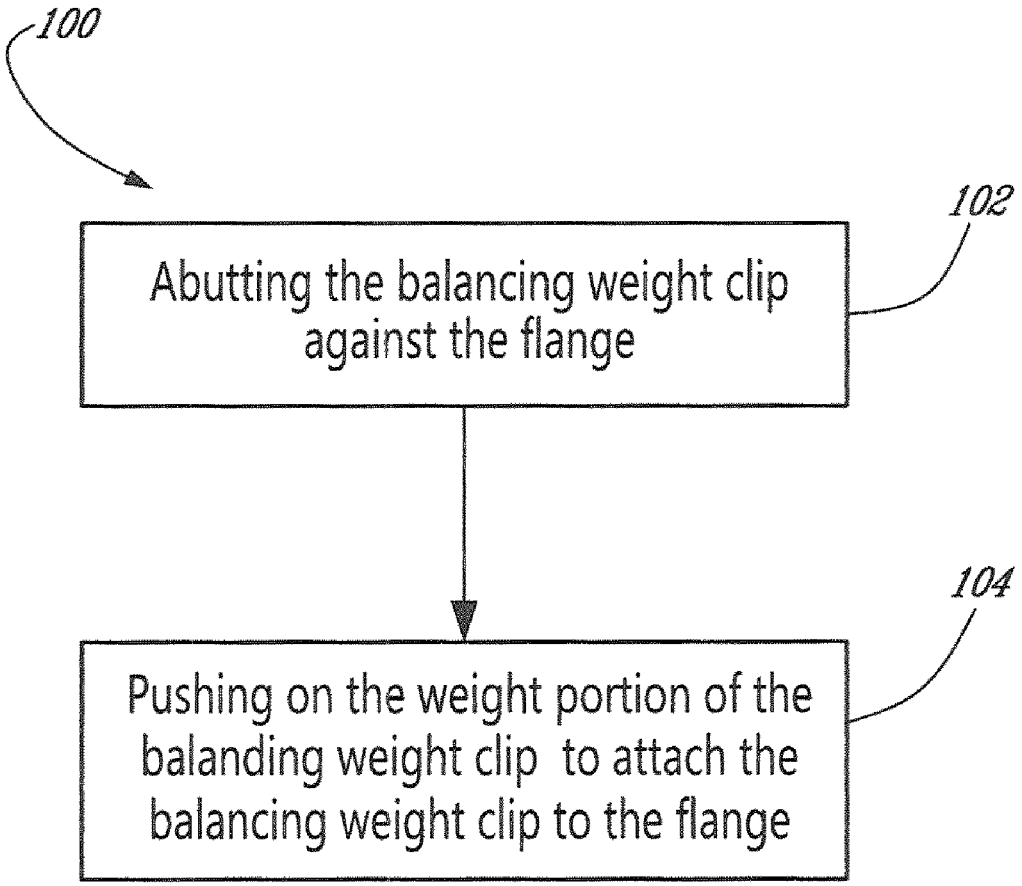
FIG. 8 is a flow chart of a method for balancing a rotor assembly.

FIG. 8 illustrates one method 100 for removably securing the balancing weight clip 36, 36' to the flange 26, 26'. The first step 102 of the method 100 is the abutment of at least one the end of the first and second flange engaging portions 40, 40' and 42, 42' against the corresponding inward and/or outward face 28, 28', 30, 30' adjacent to the circumferential edge 32, 32'. If rail segments 50, 50' are present, the balancing weight clip 36, 36' is positioned between two following rail segments 50, 50'. Alternatively, the balancing weight clip 36, 36' is positioned such that the detent 44, 44' is aligned with a corresponding groove segment.

The last step 104 consists in pushing on the balancing weight clip 36, 36' such that the first and second flange engaging portions 40, 40', and 42, 42' engages the inward and outward faces 28, 28', and 30, 30', respectively. Since at least one of the first and second flange engaging portions 40, 40', and 42, 42' is elastically deformable, the first and second flange engaging portions 40, 40', and 42, 42' move away from each other and engage the inward and outward faces 28, 28', and 30, 30', respectively. The insertion is completed when the detent 44, 44' engages the circumferential groove 52.

In one embodiment, the balancing weight clip 36, 36' is inclined with respect to the flange 26, 26' before the abutment 102. Taking the example of the insertion of the balancing weight clip 36 on the flange 26, the balancing weight clip 36 is inclined such that the insertion face 46 of the second flange engaging portion 42 abuts against the outward face 30 of the flange 26 adjacent to the circumferential edge 32. Then, the balancing weight clip 36 is pivoted such that the detent 44 of the first flange engaging portion 40 abuts against the corner between the inward face 28 and the circumferential edge 32. The last step is to push on the weight portion 38. As at least the second flange engaging portion 42 is elastically deformable, the first and second flange engaging portions 40 and 42 are moved away from each other and the detent 44 slides on the inward face 28 of the flange 26 while the insertion face 46 slides on the outward face 30. The insertion is completed when the detent 44 engages the groove 52.

In another embodiment, the first and second flange engaging portions 40, 40' and 42, 42' have substantially the same width. In this case, the step 102 comprises abutting the detent 44, 44' against the corner between the inward face 28, 28' of the flange 26, 26' and the circumferential edge 30, 32', while abutting the insertion face 46, 46' against the corner between the outward face 30, 30' of the flange 26, 26' and the circumferential edge 32, 32'. The last step is to push on the weight portion 38, 38'. As at least one of the first second flange engaging portion 40, 40' and 42, 42' is elastically deformable, the first and second flange engaging portions 40, 40' and 42, 42' are moved away from each other and the detent 44, 44' slides on the inward face 28, 28' of the flange 26, 26' while the insertion face 46, 46' slides on the outward face 30, 30'. The insertion is completed when the detent 44, 44' engages the groove.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A rotor assembly for a gas turbine engine, comprising:

a disc adapted for mounting to an engine shaft defining a longitudinal axis, the disc having two opposed faces and a circumferential blade receiving edge therebetween adapted for mounting of a plurality of radially projecting blades;

an axially extending flange projecting from one of the two opposed faces of the disc and annularly extending therearound at a radially location that is spaced apart from the circumferential blade receiving edge of the disc, the flange having a circumferential groove therein; and at least one balancing weight clip engaged solely to the axially extending flange and having a length which covers only a portion of the circumference of the annular axially extending flange, the balancing weight clip having a mass balancing the rotor assembly and comprising a first flange engaging portion, a second flange engaging portion and a weight portion therebetween, the weight portion and the first and second flange engaging portions defining a flange receiving opening, the first flange engaging portion being provided with a detent facing the second flange engaging portion and mating with the circumferential groove, the at least one balancing weight clip being removably secured to the flange in a secured position wherein the flange is received in the flange receiving opening and the detent engages the circumferential groove, the balancing weight clip being immobile in an axial and circumferential direction when in the secured position, at least one of the first and second flange engaging portions being elastically deformable so that the first and second flange engaging portions are elastically moveable away from one another to receive the flange in the flange receiving opening.

2. The rotor assembly as claimed in claim 1, wherein the flange further comprises a plurality of rail segments each extending circumferentially about the flange, a distance between two following ones of the plurality of rail segments being substantially equal to a length of the balancing weight clip, the two following ones of the plurality of rail segments being positioned such that the balancing weight clip abuts against and lies between the two following ones of the plurality of rail segments when in the secured position, thereby preventing circumferential rotation of the balancing weight clip about the flange.

3. The rotor assembly as claimed in claim 1, wherein an edge of the flange comprises a plurality of recesses being circumferentially positioned thereabout.

4. The rotor assembly as claimed in claim 3, wherein the at least one balancing weight clip bridges a corresponding one of the plurality of recesses, when in the secured position.

5. The rotor assembly as claimed in claim 4, wherein the first and second flange engaging portions of the at least one balancing weight clip each comprise a rivet receiving hole.

6. The rotor assembly as claimed in claim 5, further comprising at least one rivet engaged in the rivet receiving holes and fixedly secured to the at least one balancing weight clip.

7. The rotor assembly as claimed in claim 6, wherein a circumferential length of each one of the plurality of recesses is substantially equal to a width of the at least one rivet.

8. The rotor assembly as claimed in claim 1, wherein the circumferential groove is discontinuous about the flange to form a plurality of groove segments each mating with the detent, the detent of the at least one balancing weight clip being engaged in a particular one of the plurality of groove segments and circumferentially abutting against walls of the particular one of the plurality of groove segments in order to prevent any circumferential displacement of the at least one balancing weight clip about the flange.

9. A balancing weight clip for a rotor assembly of a gas turbine engine, comprising:

a weight portion defining a mass adapted to balance the rotor assembly, the weight portion being disposed between a first flange engaging portion and a second flange engaging portion, the first and second flange engaging portions extending from and being integrally formed with the weight portion; and a first flange engaging portion and a second flange engaging portion extending from the weight portion, the weight portion and the first and second flange engaging portions defining a flange receiving opening for receiving a flange of a disc of the rotor assembly, the first flange engaging portion being provided with a detent facing the second flange engaging portion and engageable with a mating groove provided on a face of the flange, at least one of the first and second flange engaging portions being elastically deformable so that the first and second flange engaging portions are elastically moveable away from one another to removably receive the flange in the flange receiving opening and engage the detent with the mating groove.

10. The balancing weight clip as claimed in claim 9, wherein a distance between the detent and the second flange engaging portion is less than a thickness of the flange.

11. The balancing weight clip as claimed in claim 9, wherein a width of the second flange engaging portion is less than a width of the first flange engaging portion.

12. The balancing weight clip as claim in claim 9, wherein a distance between the first and second flange engaging portions is constant along a width of the first and second flange engaging portions.

13. The balancing weight clip as claimed in claim 9, wherein a distance between the first and second flange engaging portions distal to the weight portion is less than a distance between the first and second flange engaging portions proximal to the weight portion.

14. The balancing weight clip as claimed in claim 9, wherein the detent is bulb-shaped.

15. The balancing weight clip as claimed in claim 9, wherein an end of the second flange engaging portion comprises a inclined insertion face.

16. The balancing weight clip as claimed in claim 9, wherein the first and second flange engaging portions are curved along a length thereof, a curvature of the first and second flange engaging portions being substantially equal to a curvature of the flange.

17. The balancing weight clip as claimed in claim 9, wherein the first and second flange engaging portions each comprise a hole for receiving a rivet.

18. A method for balancing a rotor disc having two opposed faces and an axially extending flange projecting from one of the two opposed faces of the disc and annularly extending therearound at a radial location that is spaced apart from a circumferential blade receiving edge of the disc between the two opposed faces of the disc and adapted for mounting of a plurality of radially projecting blades, the flange having a circumferential groove therein, the method comprising:

abutting a balancing weight clip against the flange of the rotor disc, the balancing weight clip having a mass adapted to balance the rotor disc, the balancing weight clip having a weight portion and a first flange engaging portion and a second flange engaging portion extending from the weight portion, the weight portion being disposed between the first and second flange engaging portions which extend from and are integrally formed with the weight portion, the weight portion and the first and second flange engaging portions defining a flange receiving opening therebetween for receiving the flange of the rotor disc, the first flange engaging portion being provided with a detent facing the second flange engaging portion and mating with the circumferential groove, at least one of the first and second flange engaging portions being elastically deformable, the abutting the balancing weight clip comprising abutting at least one of the first and second flange engaging portions against the flange; and engaging the balancing weight clip solely to the axially extending flange of the disc by exerting a force on the weight portion in order to insert the flange in the flange receiving opening and engage the detent of the first flange portion in the circumferential groove of the axially extending flange of the disc, wherein exerting the force on the weight portion results in elastically moving away the first and second flange engaging portions from one another.

19. The method as claimed in claim 18, further comprising positioning the balancing weight clip between two following ones of a plurality of rail segments each extending circumferentially on the flange, a circumferential distance between the two following ones of the plurality of rail segments being substantially equal to a length of the balancing weight clip.

20. The method as claimed in claim 19, wherein the positioning the balancing weight clip comprises positioning the balancing weight clip over a recess in the flange.

* * * * *